United States Patent [19]

Smith

[11] 4,038,698

[45] Aug. 2, 1977

[54] ONE-PIECE RAINSUIT AND FACE MASK

[76] Inventor: Leroy Smith, 103 Ariel Place, Bricktown, N.J. 08723

[21] Appl. No.: 692,951

[22] Filed: June 4, 1976

[51] Int. Cl.[2] ..... A41D 13/02

[52] U.S. Cl. ..... 2/79; 2/82; 2/84; 126/204; 165/46

[58] Field of Search ..... 2/82, 84, 79, 2.1 A, 2/9, 10, DIG. 1, DIG. 7; 128/142, 142.4, 142.5, 142.7, 145; 126/204; 165/46

[56] References Cited

U.S. PATENT DOCUMENTS

| | | | |
|---|---|---|---|
| 2,006,373 | 7/1935 | Thompson | 2/79 |
| 2,344,920 | 3/1944 | Maggi | 2/9 X |
| 2,500,982 | 3/1950 | Fligel | 2/84 |
| 3,130,416 | 4/1964 | Mitchell et al. | 2/79 |
| 3,153,720 | 10/1964 | Petronio et al. | 126/204 X |
| 3,229,681 | 1/1966 | Gluckstein et al. | 128/142.4 X |
| 3,280,403 | 10/1966 | Nevitt | 2/79 |
| 3,665,517 | 5/1972 | Hyman | 2/82 X |

*Primary Examiner*—H. Hampton Hunter
*Attorney, Agent, or Firm*—Allen D. Brufsky

[57] ABSTRACT

A one-piece rainsuit having mask removably attached thereto. Exhaled air is directed through the mask to the interior of the rainsuit to warm the interior of the rainsuit.

3 Claims, 2 Drawing Figures

ONE-PIECE RAINSUIT AND FACE MASK

BACKGROUND OF THE INVENTION

This invention relates to garments for outdoor wear, and more particularly, to one-piece protective rainwear and a face mask for use with such rainwear for added warmth and comfort.

Hunters, motorcycle riders, etc. often face sudden inclement weather. Raingear must be readily available and must be easily and quickly slipped on over other clothes. This invention relates to a rainsuit which meets these requirements and includes a mask for protecting the face of the wearer and to warm the interior of the rainsuit.

SUMMARY OF THE INVENTION

In accordance with the invention, a one-piece rainsuit is provided whose outer covering is formed from water-repellant material. The rainsuit includes a pair of adjustable legs and a torso and arm covering. The arm and legs of the wearer are slid into the leg and arm openings and a zipper extending from the neck of the garment to the bottom of the left leg closes the garment. An additional zipper on the right leg, when open, enables quick insertion of the leg, after which the zipper can be closed. Draw strings around the waist and neck of the garment can be drawn tight for additional securement. Cooperating snaps on the cuffs and arms of the garment make the interior of the garment watertight. A face mask is attached to a hood of the garment by snaps and includes a valve arrangement permitting the user to inhale and upon exhaling, the warm breath is directed to the interior of the rainsuit to warm the same.

BRIEF DESCRIPTION OF THE DRAWING

Further objects and advantages of the invention will become apparent from the following description and claims and from the accompanying drawing, wherein:

DETAILED DESCRIPTION OF THE PREFERRED EMBODIMENT

Figure 1:
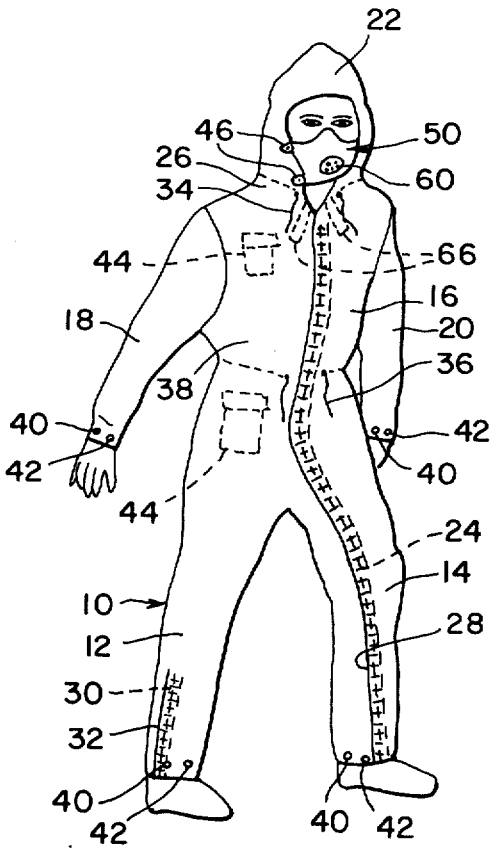
FIG. 1 is a perspective view of the rainsuit and face mask of the present invention on a user.

Referring now to the drawing in detail, wherein like numerals indicate like elements throughout the several views, a one-piece rainsuit 10 is illustrated in FIG. 1 whose outer covering is formed from water-repellant material.

Rainsuit 10 includes a pair of adjustable leg-receiving portions 12, 14 a torso covering portion 16, a pair of adjustable arm receiving portions 18, 20 and a hood 22 connected to torso portion 16. A zipper 24 runs from the neck 26 of torso portion 16 to the bottom of left leg 14 and is normally covered by a flap cover 28. A second zipper 30 protected by a flap cover 32 runs up the right leg 12.

The arms and legs of the wearer can quickly and easily be slid into the legs 12, 14 and arms 16, 18 of rainsuit 10 and the zippers 28 and 30 closed. Draw strings 34 and 36 in the rainsuit 10 about the neck 26 and waist 38, respectively are pulled tight and knotted. Cooperating snap and snap closures 40 and 42 on each leg and arm cuff can be engaged to assure that the interior of the garment is watertight. Flap-type pockets 44 can be provided on torso portion 16, if desired.

Figure 2:
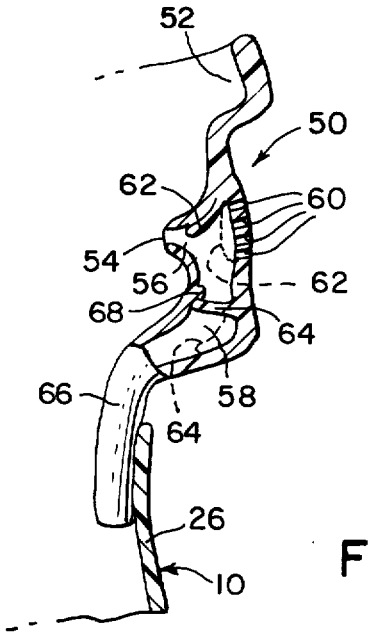
FIG. 2 is a longitudinal cross-sectional view through the face mask of FIG. 1.

Hood 22 includes a pair of snap fasteners 46 for attachment to snaps on the side of a plastic face mask 50. As shown in FIG. 2, face mask 50 includes a nose-receiving cavity 52 and a mouthpiece 54 having an opening 56 in communication with a hollow chamber 58. Chamber 58 has a plurality of air passages 60 opening externally of mask 50, allowing air to pass into chamber 58 and through mouthpiece 54 to the wearer. A one-way flap valve 62 hinged to the wall of chamber 58 covers air passages 60 when the wearer exhales and opens a second one-way flap valve 64 hinged to the wall of chamber 58 to permit exhaled warm air to pass from chamber 58 into a pair of exhale pipes tucked into the interior of each portion 26 of rainsuit 10, whereby the exhaled warm air can heat the interior of rainsuit 10 to warm the same. Upon inhalation flap valve 64 closes pipes 66 by abutment against a stop 68, and flap valve 62 opens.

The combination rainsuit 10 and face mask 50 provide a warm, watertight cover garment which can be quickly put on in the event of sudden inclement weather, and can be folded and stored conveniently when not in use.

I claim:

1. A garment for inclement weather comprising:

1. a one-piece rainsuit including leg receiving and arm-receiving portions, a torso-enveloping portion including a plurality of drawstrings for additional securement of said garment to the body of a wearer, a hood connected to said torso-enveloping portion, a first zipper means extending from the top of said torso-enveloping portion to the bottom of one of said leg receiving portions for opening and closing said rainsuit, a second zipper means on the bottom of the other of said leg receiving portions, and means on the end of each of said leg receiving portions and each of said arm receiving portions for rendering said garment water tight, said means including cooperative snap and snap closures, and 2. A face mask removably atttached to said hood, said face mask including a mouthpiece adapted to be inserted in the mouth of the wearer, an air chamber between said mouthpiece and an exterior surface of said mask, a plurality of air passages through the exterior surface of said mask establishing communication of said air chamber with air exterior of said mask, at least one exhale pipe in communication with said air chamber adapted to be inserted within said rainsuit adjacent an interior surface of said rainsuit, and valve means attached to the wall surrounding said air chamber for admitting air to chamber and into said mouthpiece through said air passages in response to inhaling by the wearer and for closing said air passages and directing air to said exhale pipe in response to exhaling of the wearer.

2. A garment in accordance with claim 1 wherein said valve means includes a pair of one-way flap valves hingedly connected to the wall of said air chamber.

3. A garment in accordance with claim 1 wherein said face mask is attached to said hood by snaps.

* * * * *